US011114735B2

(12) United States Patent
Miyamoto et al.

(10) Patent No.: US 11,114,735 B2
(45) Date of Patent: Sep. 7, 2021

(54) COAXIAL TO WAVEGUIDE TRANSDUCER INCLUDING AN L SHAPE WAVEGUIDE HAVING AN OBLIQUELY ARRANGED CONDUCTOR AND METHOD OF FORMING THE SAME

(71) Applicant: NEC CORPORATION, Tokyo (JP)

(72) Inventors: Takahiro Miyamoto, Tokyo (JP); Norihisa Shiroyama, Kanagawa (JP)

(73) Assignee: NEC CORPORATION, Tokyo (JP)

( * ) Notice: Subject to any disclaimer, the term of this patent is extended or adjusted under 35 U.S.C. 154(b) by 0 days.

(21) Appl. No.: 16/631,522

(22) PCT Filed: Jun. 1, 2018

(86) PCT No.: PCT/JP2018/021137
§ 371 (c)(1),
(2) Date: Jan. 16, 2020

(87) PCT Pub. No.: WO2019/017086
PCT Pub. Date: Jan. 24, 2019

(65) Prior Publication Data

US 2020/0203791 A1 Jun. 25, 2020

(30) Foreign Application Priority Data

Jul. 20, 2017 (JP) ..... JP2017-140559

(51) Int. Cl.
*H01P 5/103* (2006.01)
*H01P 1/02* (2006.01)
(Continued)

(52) U.S. Cl.
CPC ..... *H01P 5/103* (2013.01); *H01P 1/02* (2013.01); *H01P 1/022* (2013.01); *H01P 3/06* (2013.01); *H01P 11/005* (2013.01)

(58) Field of Classification Search
CPC ..... H01P 5/103; H01P 1/022; H01P 1/025; H01P 1/027
(Continued)

(56) References Cited

U.S. PATENT DOCUMENTS 2,981,904 A * 4/1961 Ajioka et al. ..... H01P 5/103 333/34
6,253,444 B1 * 7/2001 Le Neve ..... H01P 1/022 29/600
(Continued)

FOREIGN PATENT DOCUMENTS

GB 821150 A 9/1959
JP 53-105645 U 8/1978
(Continued)

OTHER PUBLICATIONS

Yoshihiro Konishi, "Basics of Microwave circuit and Applications thereof—from basic knowledge to new applications", General Electronic Publisher, Jan. 1990, pp. 218-220.
Paul Wade, "Rectangular Waveguide to Coax Transition Design", Nov./Dec. 2006, pp. 10-17.
International Search Report for PCT/JP2018/021137, dated Jul. 17, 2018.

*Primary Examiner* — Benny T Lee
(74) *Attorney, Agent, or Firm* — Sughrue Mion, PLLC

(57) ABSTRACT

A coaxial waveguide transducer includes: a waveguide having a substantially L shape formed of a first waveguide part and a second waveguide part arranged substantially orthogonal to each other; a stepwise step bend part formed in an outer corner part of an L-shaped bent part of the waveguide; a first conductor and a second conductor arranged in respective inner side walls of the waveguide in such a way that they are extended in a direction in which a central conductor of the coaxial line is extended and are positioned on a plane the same as that where the central conductor is provided; and a third conductor having one end connected to the central conductor and another end connected to one of the first conductor and the second conduc-
(Continued)

tor, the third conductor being arranged obliquely with respect to the direction in which the central conductor is extended.

6 Claims, 4 Drawing Sheets

(51) Int. Cl.
*H01P 3/06* (2006.01)
*H01P 11/00* (2006.01)

(58) Field of Classification Search
USPC ..... 333/26
See application file for complete search history.

(56) References Cited

U.S. PATENT DOCUMENTS

| | | | | |
|---|---|---|---|---|
| 7,515,013 | B2 * | 4/2009 | O'Connell et al. ..... | H01P 5/103<br>333/21 R |
| 2019/0341667 | A1 * | 11/2019 | Giordano ..... | H01P 3/12 |

FOREIGN PATENT DOCUMENTS

| | | | |
|---|---|---|---|
| JP | 58-23406 | U | 2/1983 |
| JP | 59-37703 | A | 3/1984 |
| JP | 60-501388 | A | 8/1985 |
| JP | 09-246801 | A | 9/1997 |
| JP | 11-46114 | A | 2/1999 |

* cited by examiner

COAXIAL TO WAVEGUIDE TRANSDUCER INCLUDING AN L SHAPE WAVEGUIDE HAVING AN OBLIQUELY ARRANGED CONDUCTOR AND METHOD OF FORMING THE SAME

CROSS REFERENCE TO RELATED APPLICATIONS

This application is a National Stage of International Application No. PCT/JP2018/021137 filed Jun. 1, 2018, claiming priority based on Japanese Patent Application No. 2017-140559 filed Jul. 20, 2017, the disclosure of which is incorporated herein in its entirety by reference.

TECHNICAL FIELD

The present disclosure relates to a coaxial waveguide transducer and a method of forming the same.

BACKGROUND ART

Many band pass filters and duplexers used in a microwave band or a millimeter wave band are formed using waveguides. However, an electronic circuit cannot directly handle a high-frequency signal transmitted through the waveguide. Therefore, when the band pass filter and the duplexer are used, they are often connected to a coaxial waveguide transducer configured to perform transduction between a waveguide and a coaxial line. Examples of the coaxial waveguide transducer are disclosed in Non-Patent Literatures 1 and 2.

In the coaxial waveguide transducer disclosed in Non-Patent Literature 1, a coaxial line and a waveguide are connected to each other in such a way that they are orthogonal to each other, and a short-circuiting plane is provided in the waveguide. Then, inside the waveguide, a signal is transmitted in a direction that is perpendicular to a signal transmission direction in the coaxial line and is opposite to the short-circuiting plane. A coaxial waveguide transducer having a structure similar to that disclosed in Non-Patent Literature 1 is disclosed in Non-Patent Literature 2 as well.

CITATION LIST

Non-Patent Literature

[Non-Patent Literature 1] Yoshihiro Konishi, "Basics of Microwave circuit and Applications thereof—from basic knowledge to new applications", General Electronic Publisher, January, 1990, pp. 218-220

[Non-Patent Literature 2] Paul Wade, "Rectangular Waveguide to Coax Transition Design", 10 Nov./Dec. 2006

SUMMARY OF THE INVENTION

Technical Problem

In recent years, the sizes of band pass filters and duplexers used in high-frequency bands have been reduced. In accordance therewith, it is required to reduce the size of the coaxial waveguide transducer as well. Further, the coaxial waveguide transducer needs to satisfy reflection characteristics indicating a reflection loss (return loss) in a desired band.

According to the coaxial waveguide transducer having the structure disclosed in Non-Patent Literature 1 and 2, when the distance between the coaxial line and the short-circuiting plane is made large, reflection characteristics can be satisfied in one band. However, when the distance between the coaxial line and the short-circuiting plane is made large, the size of the coaxial waveguide transducer increases.

Therefore, there is a problem that, with the coaxial waveguide transducer having the structure disclosed in Non-Patent Literatures 1 and 2, it is unable to achieve both miniaturization and satisfaction of reflection characteristics.

The present disclosure aims to provide a coaxial waveguide transducer and a method of forming the same capable of solving the aforementioned problem and achieving both miniaturization and satisfaction of the reflection characteristics.

Solution to the Problem

In one aspect, a coaxial waveguide transducer includes:

a waveguide having a substantially L shape formed of a first waveguide part and a second waveguide part arranged substantially orthogonal to each other, the waveguide having one end which is on the side of the first waveguide part to which a coaxial line is connected;

a stepwise step bend part formed in an outer corner part of an L-shaped bent part of the waveguide;

a first conductor and a second conductor arranged in respective inner side walls of the first waveguide part in such a way that the first conductor and the second conductor are extended in a direction in which a central conductor of the coaxial line is extended and are positioned on a plane the same as that where the central conductor is provided; and a third conductor having one end connected to the central conductor and another end connected to one of the first conductor and the second conductor, the third conductor being arranged obliquely with respect to the direction in which the central conductor is extended.

In one aspect, a method of forming a coaxial waveguide transducer comprises:

providing a waveguide having a substantially L shape formed of a first waveguide part and a second waveguide part arranged substantially orthogonal to each other, the waveguide having one end which is on the side of the first waveguide part to which a coaxial line is connected;

forming a stepwise step bend part in an outer corner part of an L-shaped bent part of the waveguide;

arranging a first conductor and a second conductor in respective inner side walls of the waveguide in such a way that the first conductor and the second conductor are extended in the direction in which a central conductor of the coaxial line is extended and are positioned on a plane the same as that where the central conductor is provided; and arranging a third conductor in such a way that one end is connected to the central conductor and another end is connected to one of the first conductor and the second conductor, and that the third conductor is extended obliquely with respect to the direction in which the central conductor is extended.

Advantageous Effects of the Invention

According to the aforementioned aspects, it is possible to provide a coaxial waveguide transducer and a method of forming the same capable of achieving both miniaturization and satisfaction of the reflection characteristics.

DETAILED DESCRIPTION OF PREFERRED EMBODIMENTS

Hereinafter, with reference to the drawings, an embodiment of the present disclosure will be explained. Further, specific numerical values and the like stated in the following embodiments are merely examples for facilitating understanding of the present disclosure, and are not limited thereto.

Figure 1:
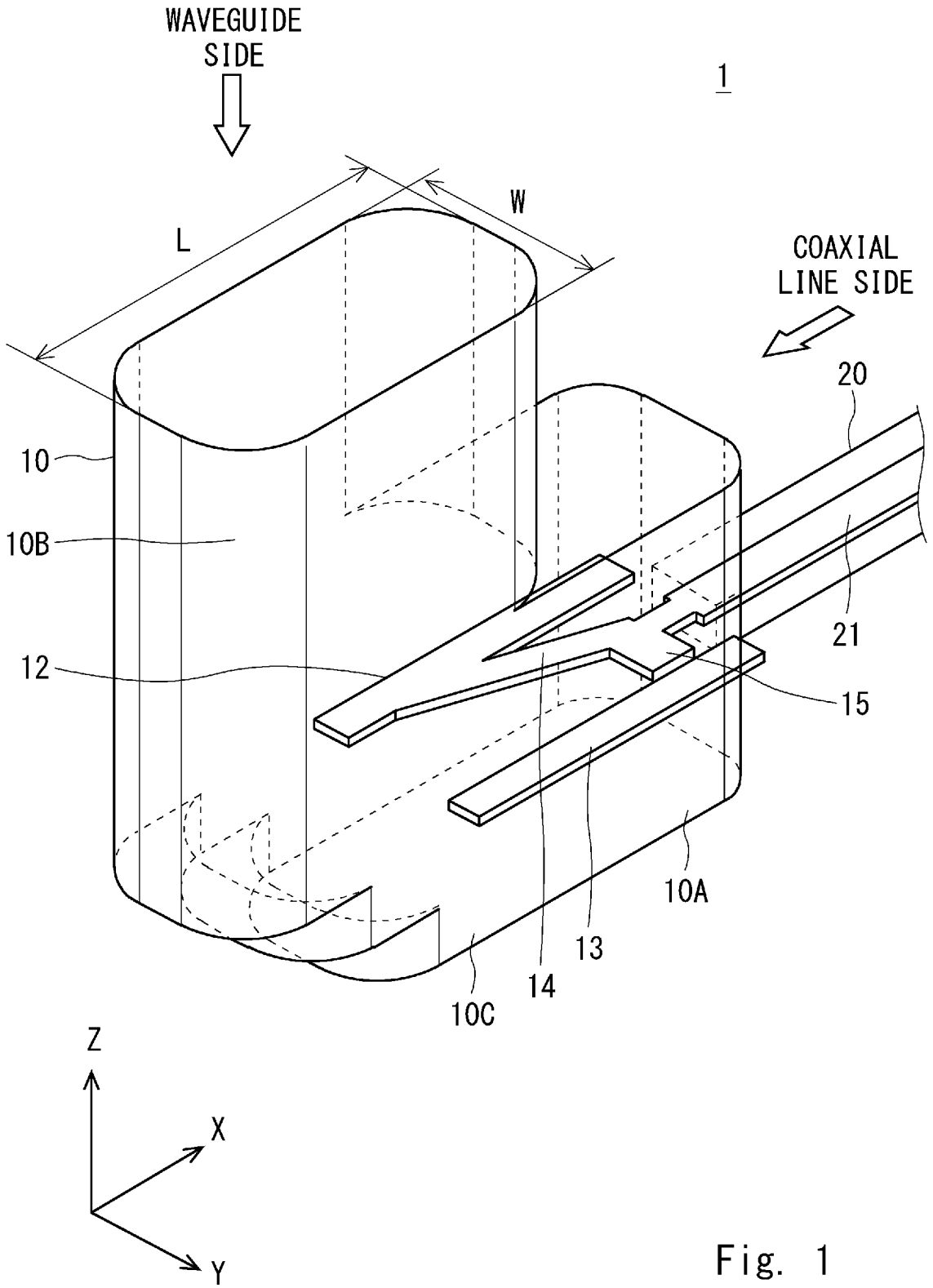
FIG. 1 is a perspective view showing a configuration example of a coaxial waveguide transducer according to an embodiment.
Figure 2:
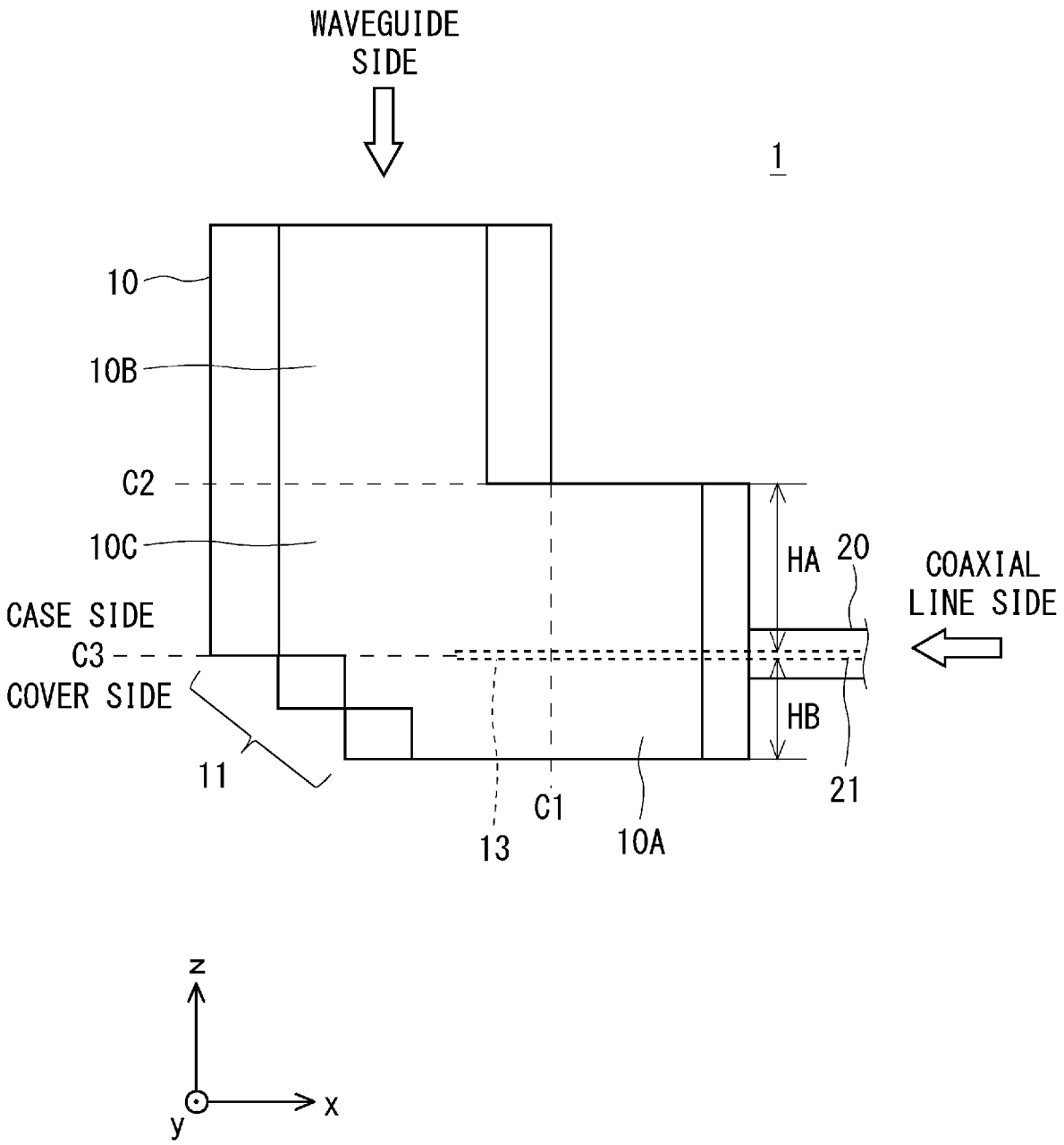
FIG. 2 is a side view showing a configuration example of the coaxial waveguide transducer according to the embodiment.
Figure 3:
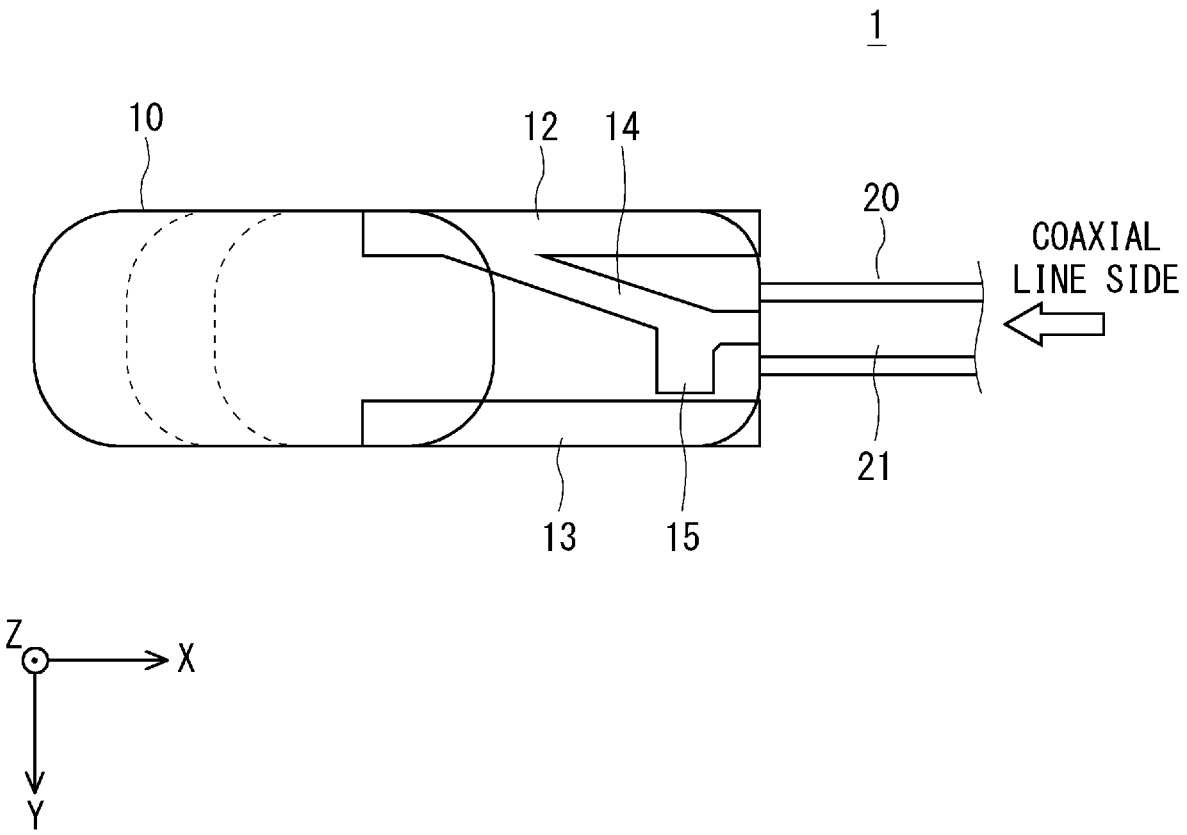
FIG. 3 is a top view showing a configuration example of the coaxial waveguide transducer according to the embodiment.

FIGS. 1-3 are a perspective view, a side view, and a top view showing configuration examples of a coaxial waveguide transducer 1 according to this embodiment, respectively.

As shown in FIGS. 1-3, the coaxial waveguide transducer 1 according to this embodiment includes a waveguide 10 having a substantially L shape formed of a first waveguide part 10A and a second waveguide part 10B arranged in such a way that they are substantially orthogonal to each other as shown in FIGS. 1 and 2. In the following description, for the sake of convenience, an L-shaped bent part of the waveguide 10 that is positioned on the x-direction negative side with respect to a line C1 shown in FIG. 2 and is on the z-direction negative side with respect to a line C2 shown in FIG. 2 is referred to as a bent part 10C as shown in FIGS. 1 and 2, where the positive x, y, and z directions are depicted in the 3-dimensional axis system included in FIGS. 1-3. Hereinafter, the direction according to the axis system in FIGS. 1-3 will be referred to as the positive side and the opposite direction will be referred to as the negative side.

The waveguide 10 has one end (x-direction positive side) on the side of the first waveguide part 10A to which a coaxial line 20 is connected in series (shown as coaxial line side in FIGS. 1-3), through which a signal of a coaxial line system is input to the waveguide 10 or output from the waveguide 10. Note that a central conductor 21 of the coaxial line 20 has a plate shape. Further, the waveguide 10 has another end (z-direction positive side) on the side of the second waveguide part 10B (shown as waveguide side in FIGS. 1-2) through which a signal of a waveguide system is input to the waveguide 10 or output from the waveguide 10. Further, the waveguide 10 includes an internal cavity that contains first to fourth conductive plates 12, 13, 14 and 15 as shown in FIGS. 1 and 3 and the like that will be described later.

When the coaxial waveguide transducer 1 according to this embodiment is used while being connected to a band pass filter or a duplexer, the band pass filter or the duplexer is connected to the other end on the side of the second waveguide part 10B.

Further, the waveguide 10 includes a stepwise step bend part 11 formed in an outer corner part of the bent part 10C as shown in FIG. 2. While the number of stages of the step bend part 11 is two in FIGS. 1-3, the number of stages of the step bend part 11 is not limited to two.

The first conductive plate 12 and the second conductive plate 13 are plate-like conductors (a first conductor and a second conductor) having side surfaces that are connected to respective inner side walls of the first waveguide part 10A of the waveguide 10 in such a way that the first conductive plate 12 and the second conductive plate 13 are extended in the direction in which the central conductor 21 of the coaxial line 20 is extended and the first conductive plate 12 and the second conductive plate 13 are flush with the central conductor 21. The first conductive plate 12 and the second conductive plate 13 are extended to the bent part 10C (that is, to the x-direction negative side with respect to the line C1 shown in FIG. 2) in the x-direction negative side. In this way, the part of the first waveguide part 10A of the waveguide 10 has a form of a ridge waveguide including the first conductive plate 12 and the second conductive plate 13 as ridges.

The third conductive plate 14 is a plate-like conductor (third conductor) having one end connected to the central conductor 21 of the coaxial line 20 and the other end connected to the first conductive plate 12, and is arranged obliquely with respect to the direction in which the central conductor 21 of the coaxial line 20 is extended. Note that the other end of the third conductive plate 14 is not limited to being connected to the first conductive plate 12 and may be connected to the second conductive plate 13.

The fourth conductive plate 15 is a plate-like conductor (fourth conductor) that is projected from one end of the third conductive plate 14 toward the second conductive plate 13 in the y-axis positive direction and is arranged in such a way that a gap is formed between the fourth conductive plate 15 and the second conductive plate 13. The resonance point of the coaxial waveguide transducer 1 is changed in accordance with the length of this gap. Therefore, by adjusting the length of the gap between the fourth conductive plate 15 and the second conductive plate 13, the reflection characteristics of the coaxial waveguide transducer 1 can be finely-adjusted. When the other end of the third conductive plate 14 is connected to the second conductive plate 13, the fourth conductive plate 15 is projected toward the first conductive plate 12 in the y-axis negative direction, and is arranged in such a way that a gap is formed between the fourth conductive plate 15 and the first conductive plate 12.

Incidentally, the waveguide 10 is configured to hold a plate-like conductive plate on a horizontal plane by a case (not shown) where a concave part is formed and a cover (not shown) where a concave part is formed. In other words, the waveguide 10 is configured to be divided into the case and the cover on the horizontal plane and to hold the plate-like conductive plate between the case and the cover that have been divided. Therefore, in FIG. 2, a cavity on the z-direction positive side with respect to a line C3 corresponds to the concave part formed in the case (shown as case side in FIG. 2) and the cavity on the z-direction negative side with respect to the line C3 corresponds to the concave part formed in the cover (shown as cover side in FIG. 2). From the above discussion, the material of the waveguide 10 is the same as that of the case and the cover. It is sufficient that the material of the case and the cover be metal having a high conductivity such as aluminum.

Further, the central conductor 21 of the coaxial line 20, the first to fourth conductive plates 12-15 and the like are integrally formed in the conductive plate held by the case and the cover. Therefore, the central conductor 21 of the coaxial line 20, the first to fourth conductive plates 12-15 and the like are positioned on the same plane (horizontal plane in FIGS. 1-3).

As described above, the first to fourth conductive plates 12-15 and the central conductor 21 of the coaxial line 20 are formed of the same material since they are integrally formed in the conductive plate held between the case and the cover.

It is sufficient that the material of the first to fourth conductive plates 12-15 and the central conductor 21 be metal having a high conductivity such as copper. Further, the material of the first to fourth conductive plates 12-15 and the central conductor 21 may be an insulator such as plastic whose surface is plated with a highly conductive metal.

In this embodiment, when a signal of the coaxial line system is input to one end (x-direction positive side) of the waveguide 10 on the side of the first waveguide part 10A, the signal of this coaxial line system is transduced into a signal of the waveguide system, the transduced signal proceeds to the x-direction negative side, then the signal path is bent at a substantially right angle on the z-direction positive side in the step bend part 11, and the resulting signal is output from the other end (z-direction positive side) of the waveguide 10 on the side of the second waveguide part 10B.

On the other hand, when a signal of the waveguide system is input to the other end (z-direction positive side) of the waveguide 10 on the side of the second waveguide part 10B, this signal of the waveguide system proceeds to the z-direction negative side, the signal path is bent at a substantially right angle on the x-direction positive side in the step bend part 11, the signal is transduced into a signal of the coaxial line system, and the resulting signal is output from one end (x-direction positive side) of the waveguide 10 on the side of the first waveguide part 10A.

In the coaxial waveguide transducer 1 according to this embodiment, the step bend part 11 is formed in the outer corner part of the L-shaped bent part 10C of the waveguide 10, whereby the size of the part of the coaxial waveguide transducer 1 on the side of the cover is reduced. In order to further reduce this size, a height HB (FIG. 2) between the bottom surface of the first waveguide part 10A of the waveguide 10 and the central conductor 21 of the coaxial line 20 is lowered.

When, however, the size of the part of the coaxial waveguide transducer 1 on the side of the cover is reduced, as described above, the boundary between the cover and the case (line C3 shown in FIG. 2 where the conductive plate is positioned) becomes close to the cover. Therefore, the height of the step bend part 11 cannot be increased. As a result, with the coaxial waveguide transducer 1, reflection characteristics cannot be satisfied.

In order to solve the above problem, in this embodiment, in the first waveguide part 10A of the waveguide 10 on the side of the coaxial line 20, the first conductive plate 12 and the second conductive plate 13 that are extended in the direction in which the central conductor 21 of the coaxial line 20 is extended are arranged in the respective inner side walls of the first waveguide part 10A, and the third conductive plate 14 that is extended obliquely from the central conductor 21 of the coaxial line 20 and is connected to the first conductive plate 12 is arranged. According to the above configuration, the first waveguide part 10A of the waveguide 10 on the side of the coaxial line 20 is configured to have a form of a ridge waveguide including the first conductive plate 12 and the second conductive plate 13 as ridges, whereby the reflection characteristics can be satisfied.

Figure 4:
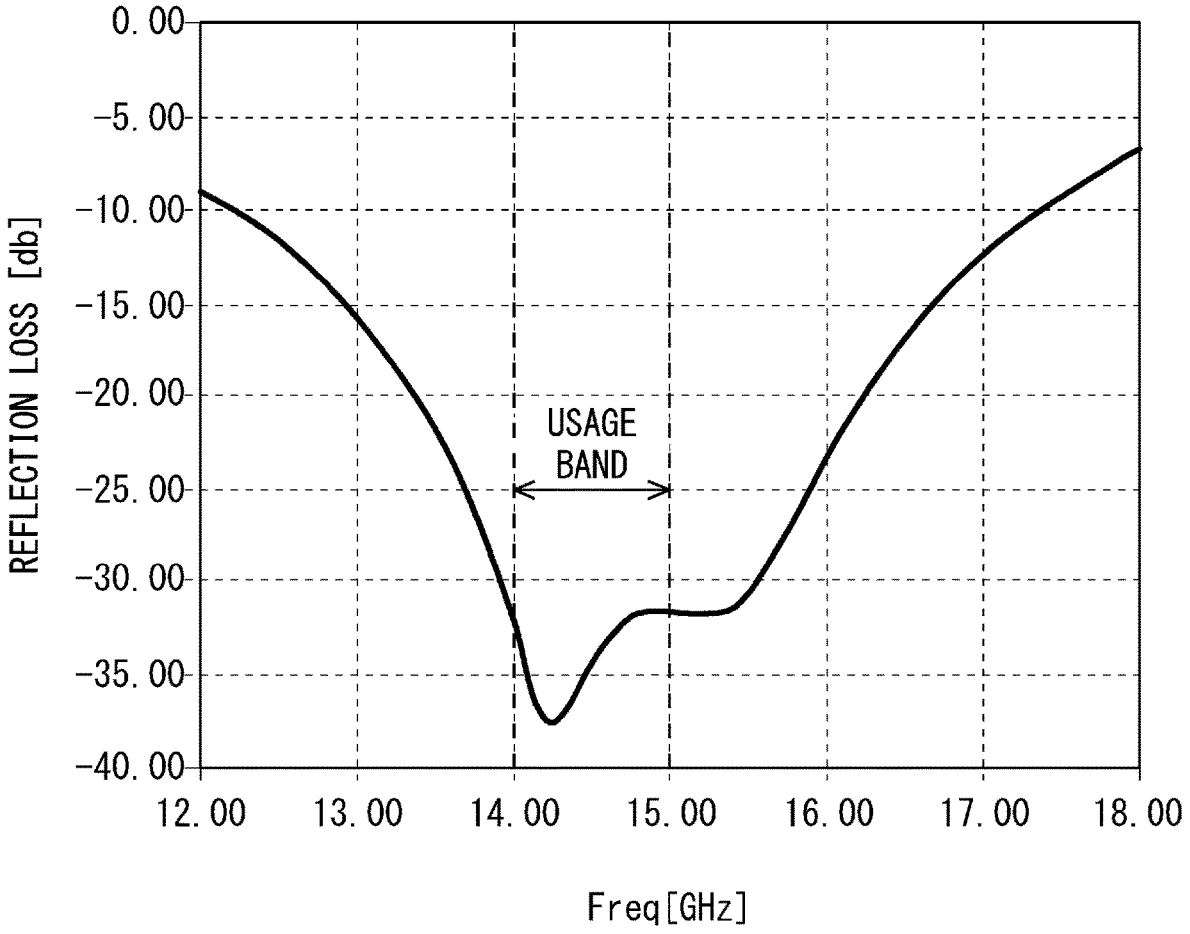
FIG. 4 is a graph showing an example of reflection characteristics of the coaxial waveguide transducer according to the embodiment.

Referring now to FIG. 4, it will be explained that the reflection loss characteristics can be satisfied due to the effects of the first conductive plate 12 and the second conductive plate 13 in this embodiment.

FIG. 4 is a graph showing an example of reflection loss characteristics of the coaxial waveguide transducer 1 according to this embodiment. In FIG. 4, the horizontal axis indicates a frequency [GHz] and the vertical axis indicates a reflection loss [dB], In FIG. 4, it is assumed that the usage band of the coaxial waveguide transducer 1 is between 14 and 15 [GHz], Further, the height HA (FIG. 2) between the upper surface of the first waveguide part 10A of the waveguide 10 and the central conductor 21 of the coaxial line 20 is set to 7.75 [mm], the above height HB (FIG. 2) is set to 4.85 [mm], and the thickness of the central conductor 21 of the coaxial line 20 and the first to fourth conductive plates 12-15 is set to 0.3 [mm]. Further, regarding the other end (z-direction positive side) of the waveguide 10 on the side of the second waveguide part 10B, the length L in the x direction is set to 15.8 [mm] and the width W in the y direction is set to 7.9 [mm] as shown in FIG. 1.

As shown in FIG. 4, in this embodiment, it is confirmed that the reflection loss equal to or larger than 30 [dB] can be secured in a band between 14 and 15 [GHz], which is a usage band.

Therefore, it is confirmed that the reflection characteristics can be satisfied within a desired usage band due to the effects of the first conductive plate 12 and the second conductive plate 13 in this embodiment.

In this embodiment, as described above, by adjusting the length of the gap between the fourth conductive plate 15 and the second conductive plate 13, the graph of the reflection loss characteristics shown in FIG. 4 may be finely-adjusted. When the length of this gap is adjusted, the value of the horizontal axis or the vertical axis of the graph shown in FIG. 4 is shifted.

As described above, in this embodiment, the stepwise step bend part 11 is formed in the outer corner part of the L-shaped bent part 10C of the waveguide 10 having a substantially L shape. It is therefore possible to reduce the size of the coaxial waveguide transducer 1.

Further, in this embodiment, in the first waveguide part 10A of the waveguide 10 on the side of the coaxial line 20, the first conductive plate 12 and the second conductive plate 13 that are extended in the direction in which the central conductor 21 of the coaxial line 20 is extended are arranged in the respective inner side walls of the first waveguide part 10A, and the third conductive plate 14 that is extended obliquely from the central conductor 21 of the coaxial line 20 and is connected to the first conductive plate 12 is arranged. As described above, the first waveguide part 10A of the waveguide 10 on the side of the coaxial line 20 is configured to have a form of the a ridge waveguide having the first conductive plate 12 and the second conductive plate 13 as ridges, whereby it is possible to satisfy the reflection characteristics in a desired band.

According to the above discussion, the coaxial waveguide transducer 1 according to this embodiment is able to achieve both miniaturization and satisfaction of the reflection characteristics.

While the present disclosure has been described with reference to the aforementioned embodiment, the present disclosure is not limited to the aforementioned embodiment. Various changes that can be understood by those skilled in the art can be made to the configurations and the details of the present disclosure within the scope of the present disclosure.

For example, while there is an advantage that the shape of the central conductor of the coaxial line and the first to fourth conductors is a plate shape and thus they can be integrally formed in one conductive plate in the aforementioned embodiment, the shape of the central conductor of the coaxial line and the first to fourth conductors is not limited to the plate shape. The shape of the central conductor of the coaxial line and the first to third conductors may be, for example, a columnar shape, a rectangular parallelepiped shape or the like.

Further, while the case in which the coaxial waveguide transducer performs transduction between the coaxial line and the waveguide has been described in the aforementioned embodiment, this is merely an example. The present disclosure can be applied also to a case in which, for example, a planar line such as a stripline or a microstripline is used in place of the coaxial line. In this case, it is possible to perform transduction between these planar lines and the waveguide.

REFERENCE SIGNS LIST

1 COAXIAL WAVEGUIDE TRANSDUCER
10 WAVEGUIDE
10A FIRST WAVEGUIDE PART
10B SECOND WAVEGUIDE PART
10C BENT PART
11 STEP BEND PART
12 FIRST CONDUCTIVE PLATE
13 SECOND CONDUCTIVE PLATE
14 THIRD CONDUCTIVE PLATE
15 FOURTH CONDUCTIVE PLATE
20 COAXIAL LINE
21 CENTRAL CONDUCTOR

The invention claimed is:

1. A coaxial waveguide transducer comprising:

a waveguide having a substantially L shape formed of a first waveguide part and a second waveguide part arranged substantially orthogonal to each other, the waveguide having one end which is on a side of the first waveguide part to which a coaxial line is connected;

a stepwise step bend part formed in an outer corner part of an L-shaped bent part of the waveguide;

a first conductor and a second conductor arranged along respective inner side walls of the first waveguide part in such a way that the first conductor and the second conductor are extended in a direction in which a central conductor of the coaxial line is extended and are positioned on a plane that is the same as a plane where the central conductor is provided; and a third conductor having one end connected to the central conductor and another end connected to one of the first conductor and the second conductor, the third conductor being arranged obliquely with respect to the direction in which the central conductor is extended.

2. The coaxial waveguide transducer according to claim 1, wherein the first conductor and the second conductor are extended to the L-shaped bent part of the waveguide.

3. The coaxial waveguide transducer according to claim 1, further comprising a fourth conductor that is projected from one end of the third conductor toward the other one of the first conductor and the second conductor and is arranged in such a way that a gap is formed between the fourth conductor and the other one of the first conductor and the second conductor.

4. The coaxial waveguide transducer according to claim 1, wherein the central conductor of the coaxial line, the first conductor, the second conductor, and the third conductor are plate-like conductive plates positioned on the plane.

5. The coaxial waveguide transducer according to claim 4, wherein the waveguide is configured to be divided into two members on the plane and to hold the plate-like conductive plate by the two members, and the central conductor of the coaxial line, the first conductor, the second conductor, and the third conductor are integrally formed in the conductive plate.

6. A method of forming a coaxial waveguide transducer, the method comprising:

providing a waveguide having a substantially L shape formed of a first waveguide part and a second waveguide part arranged substantially orthogonal to each other, the waveguide having one end which is on a side of the first waveguide part to which a coaxial line is connected;

forming a stepwise step bend part in an outer corner part of an L-shaped bent part of the waveguide;

arranging a first conductor and a second conductor along respective inner side walls of the waveguide in such a way that the first conductor and the second conductor are extended in the direction in which a central conductor of the coaxial line is extended and are positioned on a plane that is the same as a plane where the central conductor is provided; and arranging a third conductor in such a way that one end is connected to the central conductor and another end is connected to one of the first conductor and the second conductor, and that the third conductor is extended obliquely with respect to the direction in which the central conductor is extended.

* * * * *